US012090368B2

(12) United States Patent
Conigliaro

(10) Patent No.: US 12,090,368 B2
(45) Date of Patent: Sep. 17, 2024

(54) BOWLING BALL FINGER GRIP

(71) Applicant: Joseph Conigliaro, Valley Stream, NY (US)

(72) Inventor: Joseph Conigliaro, Valley Stream, NY (US)

( * ) Notice: Subject to any disclaimer, the term of this patent is extended or adjusted under 35 U.S.C. 154(b) by 113 days.

(21) Appl. No.: 17/848,589

(22) Filed: Jun. 24, 2022

(65) Prior Publication Data

US 2023/0044984 A1 Feb. 9, 2023

Related U.S. Application Data

(60) Provisional application No. 63/229,968, filed on Aug. 5, 2021.

(51) Int. Cl.
*A63B 37/00* (2006.01)

(52) U.S. Cl.
CPC .. *A63B 37/0002* (2013.01); *A63B 2243/0054* (2013.01)

(58) Field of Classification Search
CPC ..... A63B 37/0002; A63B 2243/0054
See application file for complete search history.

(56) References Cited

U.S. PATENT DOCUMENTS 2,843,382 A * 7/1958 Ross ..... A63B 37/0002 273/DIG. 16
3,004,762 A * 10/1961 Frost ..... A63B 37/0002 473/129
3,454,440 A * 7/1969 Steve ..... A63B 37/0002 156/98
4,289,312 A * 9/1981 Heimbigner ..... A63B 37/0002 473/130
4,623,149 A * 11/1986 Herman ..... A63B 37/0002 473/130
4,773,645 A * 9/1988 Todd ..... A63B 37/0002 473/129
5,002,276 A 3/1991 Bernhardt
5,007,640 A 4/1991 Bernhardt
5,123,644 A 6/1992 Bernhardt
5,176,378 A 1/1993 Bernhardt
5,308,061 A * 5/1994 Bernhardt ..... A63B 37/0002 473/127

(Continued)

OTHER PUBLICATIONS

Turbo, Finger Inserts, https://turbogrips.com/products/inserts/.

*Primary Examiner* — Joshua T Kennedy
(74) *Attorney, Agent, or Firm* — STERN & SCHURIN LLP

(57) ABSTRACT

An improved bowling ball finger grip or insert for a finger in a bowling ball comprising a tubular body adapted to be inserted into the finger hole of the bowling ball. The tubular body has an upper portion and a lower portion, with a bore having a uniform cross section formed through the tubular body that defines at least one finger opening that is located at the upper portion of the finger grip. The lower portion defines a lower wall that is thicker than an upper wall that is defined by the upper portion of the finger grip. The dimensions of the lower portion and lower wall define a base of the finger grip that fits tightly within the finger hole of the bowling ball while giving the upper portion of the finger grip or finger expansion area extra room to expand as the finger of a user swells during play.

20 Claims, 2 Drawing Sheets

(56) References Cited

U.S. PATENT DOCUMENTS

| | | | | |
|---|---|---|---|---|
| 5,498,209 | A * | 3/1996 | Arutunian | A63B 37/0002 473/128 |
| 5,584,767 | A * | 12/1996 | Picchietti | A63B 37/0002 473/130 |
| 5,603,165 | A | 2/1997 | Bernhardt | |
| 5,813,918 | A | 9/1998 | Conigliaro | |
| 6,736,734 | B1 * | 5/2004 | Bernhardt | A63B 37/0002 473/130 |
| 6,837,796 | B2 | 1/2005 | Bernhardt | |
| 7,762,903 | B2 | 7/2010 | Bernhardt | |
| 2005/0049058 | A1 * | 3/2005 | Arutunian | A63B 37/0002 473/130 |
| 2008/0318701 | A1 | 12/2008 | Tessmar | |
| 2014/0274433 | A1 * | 9/2014 | Bell | A63B 37/0002 473/130 |

* cited by examiner

BOWLING BALL FINGER GRIP

RELATED APPLICATION

This application claims priority to U.S. provisional application 63/229,968, filed on Aug. 5, 2021, which is incorporated by reference herein in its entirety.

FIELD OF INVENTION

The present invention relates to improved finger inserts for use in bowling balls. More specifically, the invention involves an expanding bowling ball finger grip which enables the finger grip to expand inside the drilled holes of a bowling ball as a user's finger swell during play.

BACKGROUND OF THE INVENTION

Conventional bowling ball inserts or grips typically comprise cylindrically shaped tubes formed of urethane that fit within the drilled holes of a bowling ball. Inserts or grips are sized and contoured (typically by a bowling pro shop) so that the inserts or grips can be inserted within larger drilled holes and then glued or otherwise fixed into place. Inserts or grips are provided in many different sizes to match the finger dimensions of a particular user.

With more advanced bowlers, bowling ball finger inserts provide the ability for users to apply an enhanced delivery action on a bowling ball as the fingers exit the ball. These inserts often help provide for a smoother release, more revolutions and generate additional bowling ball speed. Inserts also often help prevent skin damage or irritation and reduce or eliminate the need for protective tape to guard the fingers of a user.

Several examples of prior art bowling finger grips or inserts are presented in U.S. Pat. Nos. 6,736,734, 5,176,378, 5,123,644, 5,308,061, 6,837,796, 5,002,276, 5,007,640 and 7,762,903. Another example of a conventional prior art finger grip is the 2-N-1 Grip presented on the Turbo website, https://turbogrips.com/products/inserts/, available since 1989.

With regard to the features of some of these prior art bowling ball finger grips, U.S. Pat. Nos. 5,002,276, 5,123,644 and 5,176,378 each disclose a bowling ball finger insert comprising a resilient tubular body with an inner surface wall comprising a plurality of ribs extending in longitudinal spaced relationship around its inner periphery and adapted to augment the spin and lift applied during delivery of the bowling ball.

U.S. Pat. No. 5,308,061 discloses a bowling ball finger hole insert which is formed of a resilient tubular body and. The insert has an oblong cylindrical inner wall surface that defines finger openings at opposite terminal ends of the insert. The finger openings have thickened parallel planer finger pads for cushioning a bowler's finger. The finger openings also have opposed arcuate finger pads for augmenting the spin and lift applied during delivery of the bowling ball. Accordingly, a bowler has a preferential choice between these two functions provided by each finger opening of the insert.

Despite the practical and utilitarian advantages of prior art bowling ball finger inserts, they still suffer from at least one major drawback. In particular, prior art bowling ball finger inserts comprise a uniform tubular cylindrical configuration that fits uniformly within a drilled hole inside a bowling ball. Even though these inserts are generally comprised of resilient urethane material, the walls of the holes into which the finger grips are inserted are predominantly rigid. This leaves no space for the inserts to expand as a user's fingers swell during play. In other words, even though the finger grips are soft, resilient and elastic, the walls of the drilled holes of the bowling ball are not, thus preventing the grips from expanding as a user's fingers swell during play. This leads to a user experiencing pain and discomfort as play continues.

SUMMARY OF THE INVENTION

In view of the limitations and drawbacks in the prior art, it is a primary object of the present invention to provide an improved bowling ball finger grip that expands in size along with the finger of a bowler as the finger swells during play.

It is another object of the present invention to provide an improved bowling ball finger grip that decreases in size along with the finger of a bowler as swelling reduces in the finger during play.

It is a further object of the present invention to provide an improved bowling ball finger grip that eliminates the need to replace a finger grip as a user's finger transforms in size during play.

It is yet another object of the present invention to provide an improved bowling ball finger grip that eliminates the need to tape.

It is another object of the present invention to provide an improved bowling ball finger grip that eliminates the need for sanding.

Additional objectives, features and advantages will be apparent from the description of the invention that follows taken in conjunction with the accompanying drawings.

In summary, there is provided in a preferred embodiment of the present invention an improved bowling ball finger grip or insert for a finger in a bowling ball comprising a tubular body adapted to be inserted into the finger hole of the bowling ball. The tubular body has an upper portion and a lower portion, with a uniform smooth bore formed through the tubular body that defines at least one finger opening that is located at the upper portion of the finger grip. The lower portion defines a lower wall that is thicker than an upper wall that is defined by the upper portion of the finger grip. The dimensions of the lower portion and lower wall define a base of the finger grip that fits tightly within the finger hole of the bowling ball while giving the upper portion of the finger grip extra room to expand as the finger of a user swells during play. Thus, the base of the finger grip is kept in place within the finger hole of the bowling ball.

Additional features and embodiments of the tarpaulin apparatus are described below in more detail.

BRIEF DESCRIPTIONS OF THE DRAWINGS

The above-described and other advantages and features of the present disclosure will be appreciated and understood by those skilled in the art from the following detailed description and drawings of which FIG. 1 is a perspective view of a preferred embodiment of the improved bowling ball finger grip of the present invention;

DETAILED DESCRIPTION OF THE INVENTION

Figure 1:
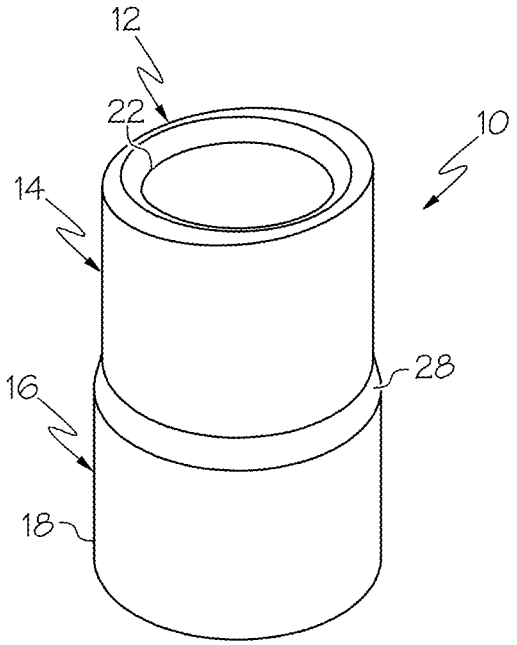

With reference to FIG. 1 through FIG. 8, there is shown a preferred embodiment of the improved bowling ball finger grip or insert 10 comprising a tubular body 12 formed of soft vinyl or urethane and adapted to be inserted into the finger hole of a bowling ball. The tubular body 12 has an upper portion 14 and a lower portion 16 that defines a base 18. The tubular body 12 is preferably formed with an internal uniform smooth bore 20 formed through the tubular body 12 that defines at least one finger opening 22 that is located at the upper portion 14 of the finger grip 10.

Figure 4:
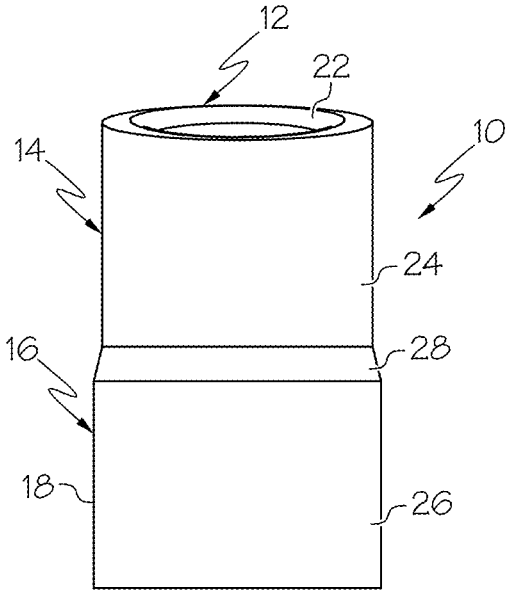
FIG. 4 is a front elevational view of the improved bowling ball finger grip.
Figure 5:
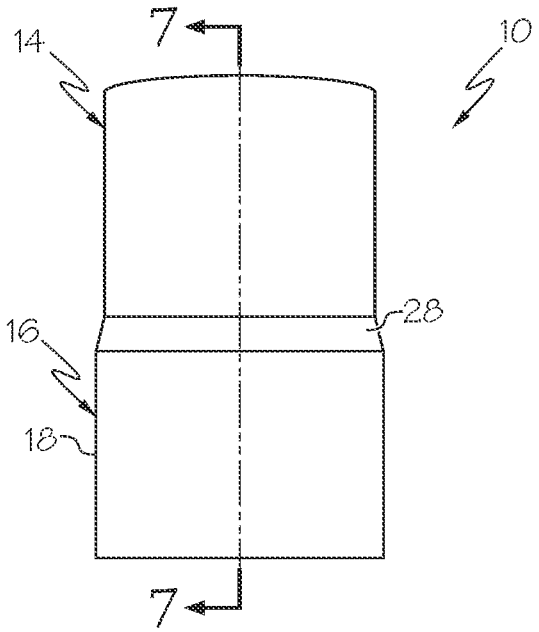
FIG. 5 is a rear elevational view of the improved bowling ball finger grip.
Figure 6:
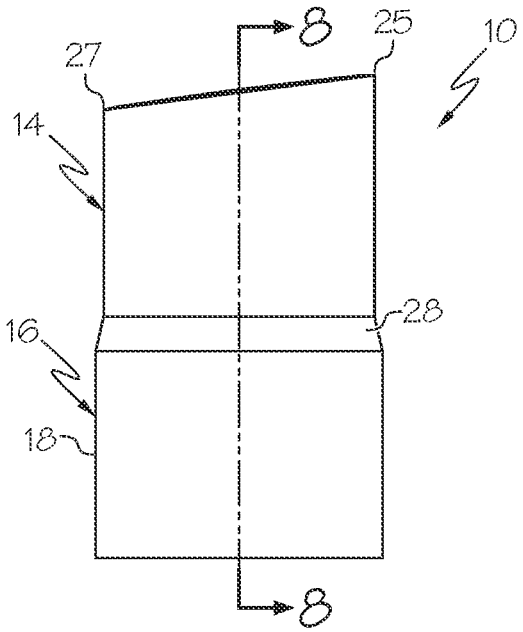
FIG. 6 is a right-side elevational view of the improved bowling ball finger grip.
Figure 7:
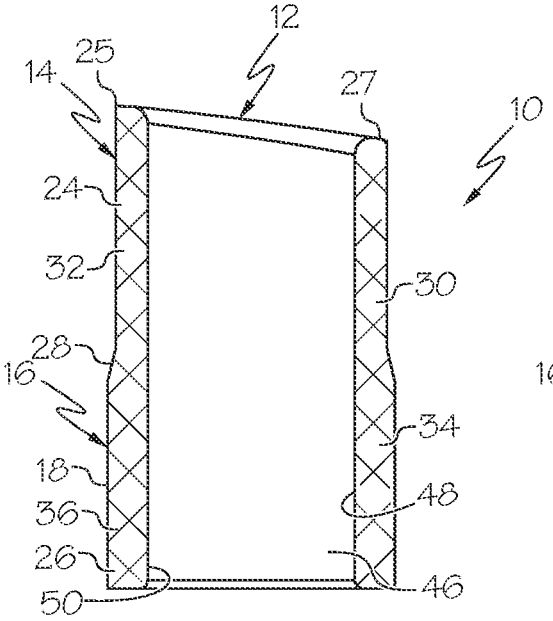
FIG. 7 is a cross-sectional view of the improved bowling ball finger grip taken along lines 7-7 of FIG. 5.

With reference to FIG. 1, FIG. 4, FIG. 5, FIG. 6, FIG. 7 and FIG. 8, a preferred embodiment of the improved bowling ball finger grip 10 comprises a lower portion 16 and base 18 that fits tightly within a finger hole of a bowling ball. Preferably with the assistance of a bowling pro shop professional, the exterior surface of the lower portion 16 is glued in place in the finger hole of a bowling ball to prevent undesired movement (e.g., rotational or otherwise) of the finger grip 10 during play. Fixing the finger grip 10 in place within the finger hole of a bowling ball also prevents the finger grip from undesirably being pushed deeper within the finger hole. As shown in FIG. 6 and FIG. 7, finger grip 10 has an uneven top which is intended to complement or correspond to the curvature of a conventional bowling ball so that finger grip 10 appears flush at the finger hole of the bowling ball when properly installed.

Figure 8:
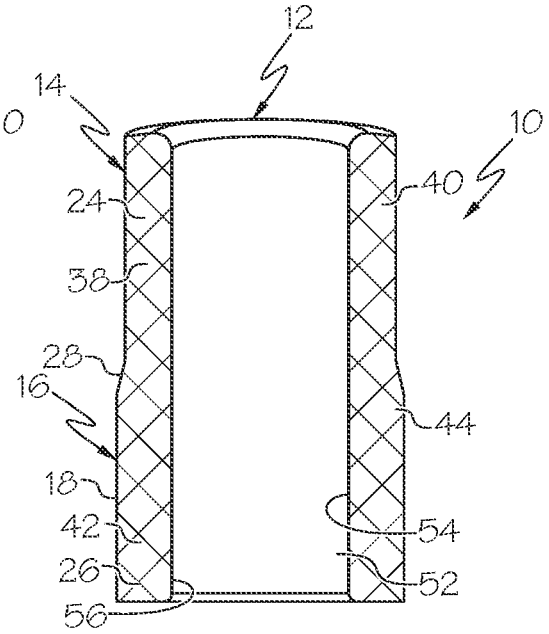
FIG. 8 is a cross-sectional view of the improved bowling ball finger grip taken along lines 5-5 of FIG. 5.

As shown most clearly in FIG. 1 and in cross-sectional views illustrated in FIG. 7 and FIG. 8, upper portion 14 and lower portion 16 of tubular body 12 are contiguous with one another, transitioning from an upper wall 24 at upper portion 14 to a thicker lower wall 26 at lower portion 16. With reference to FIG. 5 and FIG. 6, finger grip 10 has a maximum height of approximately 1.75 inches measured from the lower edge of base 18 to upper edge 25, with an intermediate height of 1.624 inches measured from the lower edge of base 18 to upper edge 27 located at the front of finger grip. The height of lower portion 16 of tubular body 12 consistently measures 0.75 inches in height around the entire circumference of lower portion 16.

In a preferred embodiment, there is a sloping exterior transition section 28 between upper portion 14 and lower portion 16. The sloping transition section 28 enables a smooth transition and benefits the structural integrity of grip 10 as it transitions between the thinner upper portion 14 and thicker lower portion 16. In a preferred embodiment, sloping exterior transition section 28 measures approximately 0.125 inches in height. With reference to FIG. 4, sloping transition section 28 forms a transition space of approximately 0.025 to 0.035 inches, and most preferably 0.030 inches, measured between the respective exterior surfaces of upper wall 24 and lower wall 26 (at the right side of the bowling ball finger grip 10). Thus, lower wall 26 extends out beyond upper wall 24 approximately 0.025 to 0.035 inches, and most preferably 0.030 inches. This transition space delineates the space into which the upper portion 14 of the finger grip 10 may stretch or expand as a finger of a user swells during play before making contact with the rigid wall of the bowling ball finger hole into which the finger grip 10 is inserted. Likewise, the transition space delineates the space from which the upper portion 14 of the finger grip 10 may later constrict as a finger of a user reduces swelling, allowing the finger grip 10 to keep constant and comfortable contact with the finger of a user during play, whether the finger is in a swelled state or not. It should be appreciated and understood that the transition space that is formed may be even greater than 0.035 inches if a larger space is desired to allow the upper wall 24 of said upper portion 14 to expand. To form a transition space which is larger, the upper wall and lower wall may be offset by a larger transition section.

Figure 2:
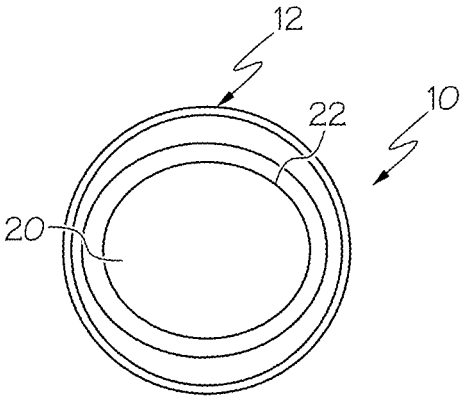
FIG. 2 is a top view of the improved bowling ball finger grip.
Figure 3:
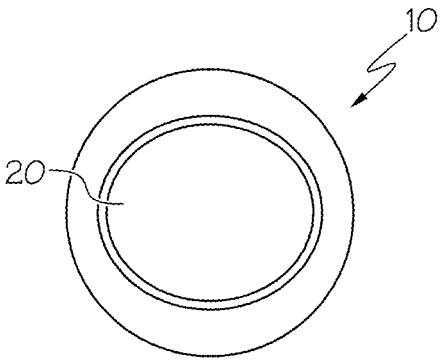
FIG. 3 is a bottom view of the improved bowling ball finger grip.

As shown most clearly in FIG. 2 and FIG. 3, improved bowling ball finger grip 10 forms a tubular body 12 that is cylindrical. Despite the tubular or cylindrical configuration, bore 20 and finger opening 22 of the finger grip 10 do not form circular configuration, and each present a mildly oblong or oval opening which better conforms to the shape of a user's finger that is inserted into finger grip 10. Notwithstanding, the mildly oblong or oval finger opening 22, the exterior dimensions of base 18 preferably form a circular configuration with all points on the exterior surface of the lower portion 16 being equidistant from the center.

In a preferred embodiment, the mildly oblong or oval contours of bore 20 and finger opening 22 of the improved bowling ball finger grip 10 may be further appreciated with reference to other dimensions, as follows. In particular, in a preferred embodiment, as shown in FIG. 7, the thickness of front upper wall 30 and rear upper wall 32 each measure approximately 0.115 inches. The thickness of front lower wall 34 and rear lower wall 36 each measure approximately 0.145 inches. Thus, in this embodiment, there is a transition space of 0.030 inches (i.e., 0.145-0.115=0.030). In this case, the transition space of 0.030 inches measures approximately 21% of lower walls 34, 36. It should be appreciated and understood that a larger or smaller transition space may be formed by increasing or decreasing the respective thicknesses of upper walls 30, 32 and lower walls 34, 36. As shown in FIG. 8, the thickness of left upper wall 38 and right upper wall 40 each measure approximately 0.170 inches. The thickness of left lower wall 42 and right lower wall 44 each measure approximately 0.200 inches. Based on these dimensions, there is a consistent transition space of 0.030 inches (i.e., 0.200-0.170=0.030). In this case, the transition space of 0.030 inches measures approximately 15% of lower walls 42, 44. It should be appreciated and understood that a larger or smaller transition space may be formed by increasing or decreasing the respective thicknesses of upper walls 38, 40 and lower walls 42, 44. With reference to FIG. 7, bore length 46 measures approximately 0.75 inches from front interior wall 48 to the rear interior wall 50. By contrast, as shown in FIG. 8, bore length 52 measures approximately 0.64 inches from right interior wall 54 to the left interior wall 56. Notably, bore lengths 46, 52 are uniform for the entire length of bore 20 from top to bottom of finger grip 10. With reference to FIG. 3, even though bore 20 and finger opening 22 presents a mildly oblong or oval shape, it should be appreciated an understood that the exterior walls of lower portion 16 and base 18 of finger grip 10 preferably define a circle having a 1.04 inch diameter that fits snugly into the finger hole of a bowling ball, such that the circumference of the exterior surface of lower portion 16 makes contact with the interior surface of the finger hole. Indeed, with reference to the measurements of a preferred embodiment of a finger grip 10 provided herein, one may appreciate that the measurements of the lower walls 34, 36 and bore length 46 from the front to rear of finger grip 10 add up to the same total as the measurements of the lower walls 42, 44 and bore length 52 from the left to right of finger grip 10 (i.e., 0.145+0.145+0.75=1.04; 0.200+0.200+0.64=1.04).

Notwithstanding the preferred embodiment, which utilizes a cylindrical configuration where the bore 20 and finger opening 22 do not define circular cross sections, respectively, it should be appreciated and understood that uniform smooth bore 20 and finger opening 22 may be modified to form a uniform bore and finger opening that have circular cross sections, respectively. In such an embodiment that utilizes a circular cross section, the lower portion of the finger grip comprises a diameter that is larger than the diameter of the upper portion, with the lower portion further defining a lower wall that is thicker than an upper wall defined by the upper portion of the finger grip. In that regard, in a preferred embodiment, the difference in diameter between the upper portion and lower portion is attributable to the difference in thickness between the lower wall and the upper wall.

Moreover, notwithstanding the specific measurements provided herein, it should be appreciated and understood that many different measurements configurations of an improved bowling ball finger grip 10 may be formed while still keeping within the spirit and scope of the invention. Indeed, it is expected that many different variations will be formed to conform to all different lengths, shapes and sizes of fingers belonging to users that employ finger grips. Provided that finger grip 10 comprises an upper portion 12 having an oblong, oval or circular finger opening 22, a bore 20, a transition section 28 that expands into a circular lower portion 16 having diameter that is larger than a combined span of the upper portion (formed by upper walls and bore), one may appreciate the benefits of the invention which enables upper portion or skin 12 to expand and contract with a user's finger and help prevent damage, irritation and discomfort to the finger.

The accompanying drawings illustrate several preferred embodiments of an improved bowling ball finger grip or insert. However, other types and configurations are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. For example, it should be appreciated and understood that the features illustrated in the drawings may be somewhat exaggerated and not drawn to scale. However, such drawings should not be construed as limiting the scope of the present invention which can exemplify several further embodiments while still keeping within the spirit and scope of the present invention. Moreover, while the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the terms "upper" and "lower," "front" and "rear," and "left" and "right" and other similar terms may be used herein to modify various elements. These modifiers do not imply a spatial, sequential, or hierarchical order to the modified elements unless specifically stated.

The invention claimed is:

1. A bowling ball finger grip for use by a user and adapted to be inserted into a finger hole of a bowling ball, comprising:

a soft, elastic, uninterrupted tubular body having a top and a bottom;

an upper portion defining a finger opening at said top of said tubular body and an upper wall having an at least one upper wall thickness dimension and an upper wall outer diameter;

a lower portion defining a base and a lower wall having at least one lower wall thickness dimension that is larger than said at least one upper wall thickness dimension and a lower wall outer diameter that is larger than said upper wall outer diameter;

a bore formed through an interior of said tubular body, said bore commencing at said finger opening;

a transition section between said upper wall and said lower wall;

a transition space extending from said top of said tubular body to said transition section such that it surrounds said upper wall, said transition space defined by the difference between said lower wall outer diameter and said upper wall outer diameter;

wherein said base of said lower portion is configured to fit tightly within said finger hole of said bowling ball and said upper wall is configured to expand into said transition space as a finger of a user swells during play.

2. The bowling ball finger grip of claim 1, said lower portion having a circular configuration.

3. The bowling ball finger grip of claim 2, said finger opening having an oblong configuration.

4. The bowling ball finger grip of claim 3, said bore having an oblong configuration.

5. The bowling ball finger grip of claim 2, said finger opening having a circular configuration.

6. The bowling ball finger grip of claim 5, said bore having a circular configuration.

7. The bowling ball finger grip of claim 1, said bore being smooth and having uniform dimensions from said top of said tubular body to said bottom of said tubular body.

8. The bowling ball finger grip of claim 1, said tubular body being formed of soft vinyl or urethane.

9. The bowling ball finger grip of claim 1, wherein said transition section comprises a slope of gradually increasing wall thickness between said upper wall and said lower wall.

10. The bowling ball finger grip of claim 1, wherein said transition space has a thickness dimension that measures in the range of 15 to 21 percent of said at least one lower wall thickness dimension.

11. A bowling ball finger insert, comprising:

an elastic, uninterrupted tubular body having an upper portion and a circular lower portion;

a finger opening at said upper portion of said tubular body;

a bore commencing at said finger opening;

a cavity with a uniform oblong cross section, located interior of said tubular body and configured to receive a finger;

a sloping transition section connecting said upper portion and said lower portion; and a transition space extending from said top of said tubular body to said transition section such that it surrounds said upper wall;

wherein said upper portion has an upper wall thickness dimension and an upper wall outer diameter and said lower portion has a lower wall thickness dimension and a lower wall outer diameter, said lower wall outer diameter being larger than said upper wall outer diameter; and wherein said transition space is defined by the difference of said lower wall outer diameter and said upper wall outer diameter and said upper wall expands into said transition space as a finger of a user swells.

12. The bowling ball finger insert of claim 11, wherein said transition space has a thickness dimension that measures in the range of 15 to 21 percent of said lower wall thickness dimension.

13. The bowling ball finger insert of claim 11, wherein said transition section measures approximately 0.125 inches in height.

14. The bowling ball finger insert of claim 11, said upper portion having an uneven top that complements the curvature of a conventional bowling ball.

15. The bowling ball finger insert of claim 11, wherein said lower portion has a base with a diameter in the range of 1.00 to 1.10 inches.

16. A bowling ball finger insert, comprising:

an elastic, uninterrupted tubular body having an upper portion and a lower portion;

a finger opening at said upper portion of said tubular body;

a bore commencing at said finger opening;

a cavity with a uniform cross section, located interior of said tubular body and configured to receive a finger;

a transition section connecting said upper portion and said lower portion; and a transition space extending from said top of said tubular body to said transition section such that it surrounds said upper wall;

wherein said upper portion has an upper wall thickness dimension and an upper wall outer diameter and said lower portion has a lower wall thickness dimension and an upper wall outer diameter, said lower wall outer diameter being larger than said upper wall outer diameter; and wherein said transition space is defined by the difference of said lower wall outer diameter and said upper wall outer diameter and said upper wall expands into said transition space as a finger of a user swells.

17. The bowling ball finger insert of claim 16, wherein said cavity comprises a uniform oblong cross section.

18. The bowling ball finger insert of claim 17, wherein said transition section is a sloping transition section.

19. The bowling ball finger insert of claim 18, wherein said upper portion comprises an expanding finger section that expands into said transition space towards a wall of a bowling ball as a user's finger swells during play.

20. The bowling ball finger insert of claim 19, wherein said transition space has a thickness dimension that measures in the range of 15 to 21 percent of said lower wall thickness dimension.

* * * * *